US007657980B2

(12) United States Patent
Liu

(10) Patent No.: US 7,657,980 B2
(45) **Date of Patent: *Feb. 9, 2010**

(54) FASTENER FOR A LACE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 421 days.

This patent is subject to a terminal disclaimer.

(21) Appl. No.: 11/669,532

(22) Filed: Jan. 31, 2007

(65) Prior Publication Data

US 2008/0178441 A1 Jul. 31, 2008

(51) Int. Cl.
*A43C 7/08* (2006.01)

(52) U.S. Cl. ..... 24/712.5; 24/712.1

(58) Field of Classification Search ..... None
See application file for complete search history.

(56) References Cited

U.S. PATENT DOCUMENTS 6,779,281 B1 * 8/2004 Liu ..... 36/50.1
6,782,588 B1 * 8/2004 Liu ..... 24/712.5
6,796,009 B1 * 9/2004 Liu ..... 24/712.6
6,817,070 B1 * 11/2004 Liu ..... 24/712.5
6,839,944 B1 * 1/2005 Liu ..... 24/712.1
6,938,307 B2 * 9/2005 Liu ..... 24/712.5
7,124,482 B2 * 10/2006 Kim ..... 24/712.1
7,313,849 B2 * 1/2008 Liu ..... 24/712.5
2005/0015947 A1 * 1/2005 Liu ..... 24/712.5
2005/0160569 A1 * 7/2005 Liu ..... 24/712.5

* cited by examiner

*Primary Examiner*—Jack W. Lavinder
(74) *Attorney, Agent, or Firm*—Whyte Hirschboeck Dudek SC

(57) ABSTRACT

A fastener for a lace includes a metal base, two clamp assemblies, a pull unit, and an anchoring member. Each of the clamp assemblies includes a substantially U-shaped member which has two opposite arms pivotally connected to the metal base, a U-bend connected to the arms opposite to the metal base, and a clamp member connected between and transverse to the arms. The pull unit includes a middle portion disposed over the metal base, and two opposite pull members extending from the middle portion and connected respectively to the U-shaped members. The anchoring member is made of metal, and has a press part pressing the middle portion of the pull unit against the metal base, and a plurality of anchoring legs extending from the press part, penetrating the middle portion of the pull unit, and welded to the metal base.

8 Claims, 6 Drawing Sheets

FASTENER FOR A LACE

BACKGROUND OF THE INVENTION

1. Field of the Invention

The invention relates to a fastener, more particularly to a fastener for a lace.

2. Description of the Related Art

Referring to FIG. 1, U.S. Pat. No. 6,817,070 B1 discloses a shoelace fastener including a fastener body 1, a pull unit 2 retained on the fastener body 1, and a covering band 3 penetrating through the fastener body 1 and surrounding the pull unit 2. The fastener body 1 includes a plurality of retaining studs 101 formed on top of the fastener body 1. The retaining studs 101 pierce through the pull unit 2 and are subsequently melted to form the retaining studs 101 with enlarged heads 102, thereby retaining the pull unit 2 on the fastener body 1. However, when a pulling force applied on the pull unit 2 is too large, the pull unit 2 is liable to be removed from the retaining studs 101, which renders shoelace fastener inoperable.

SUMMARY OF THE INVENTION

Therefore, the object of the present invention is to provide a lace fastener which has an improved binding strength between the components thereof.

Accordingly, the fastener for a lace of this invention includes a metal base, two clamp assemblies, a pull unit, and an anchoring member. Each of the clamp assemblies includes a substantially U-shaped member which has two opposite arms pivotally connected to the metal base, a U-bend connected to the arms opposite to the metal base, and a clamp member connected between and transverse to the arms. The pull unit includes a middle portion disposed over the metal base, and two opposite pull members extending from the middle portion and connected respectively to the U-shaped members. The anchoring member is made of metal, and has a press part pressing the middle portion of the pull unit against the metal base, and a plurality of anchoring legs extending from the press part, penetrating the middle portion of the pull unit, and welded to the metal base.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
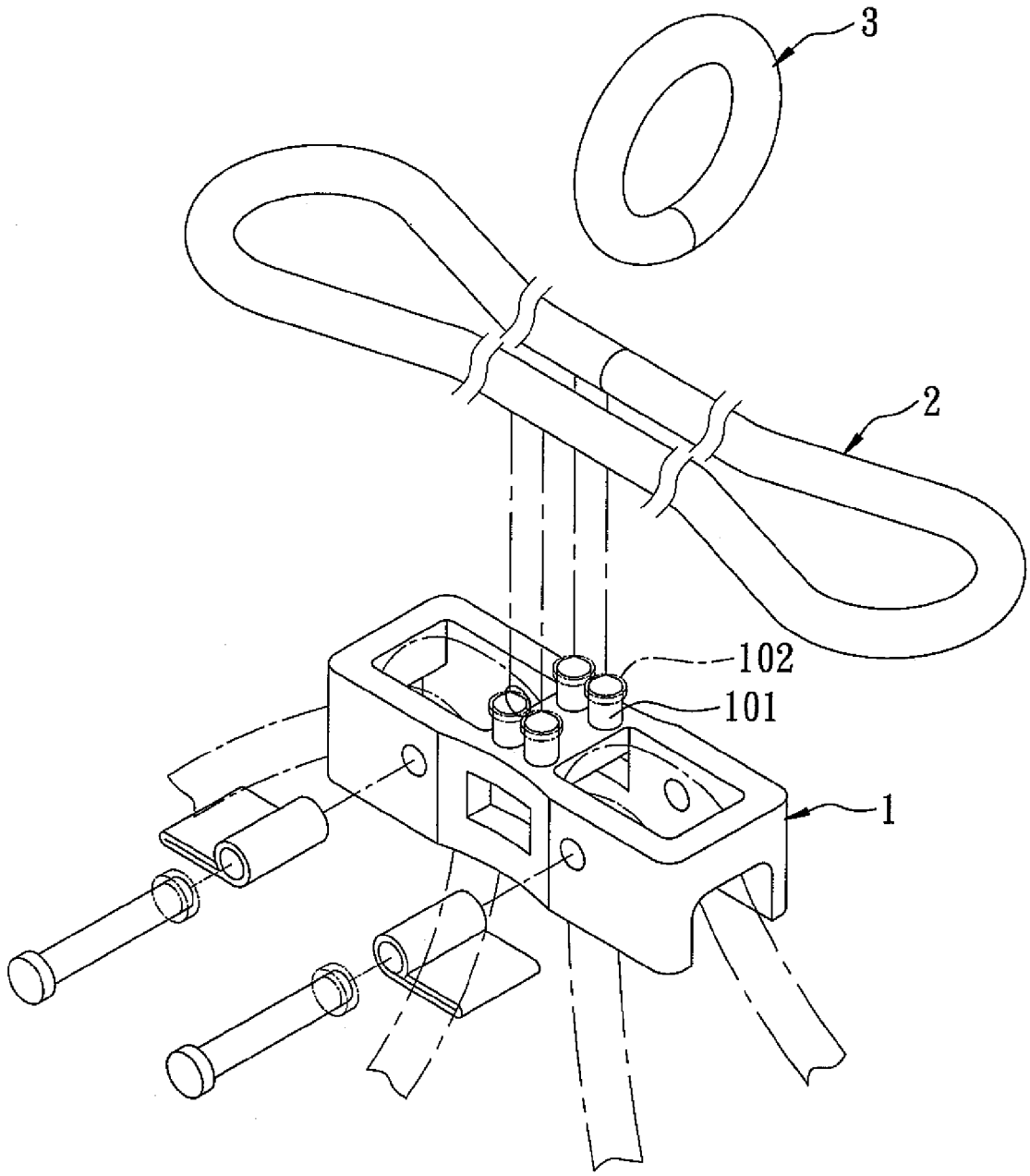
FIG. 1 PRIOR ART
FIG. 1 is an exploded perspective view of a conventional shoelace fastener.
Figure 2:
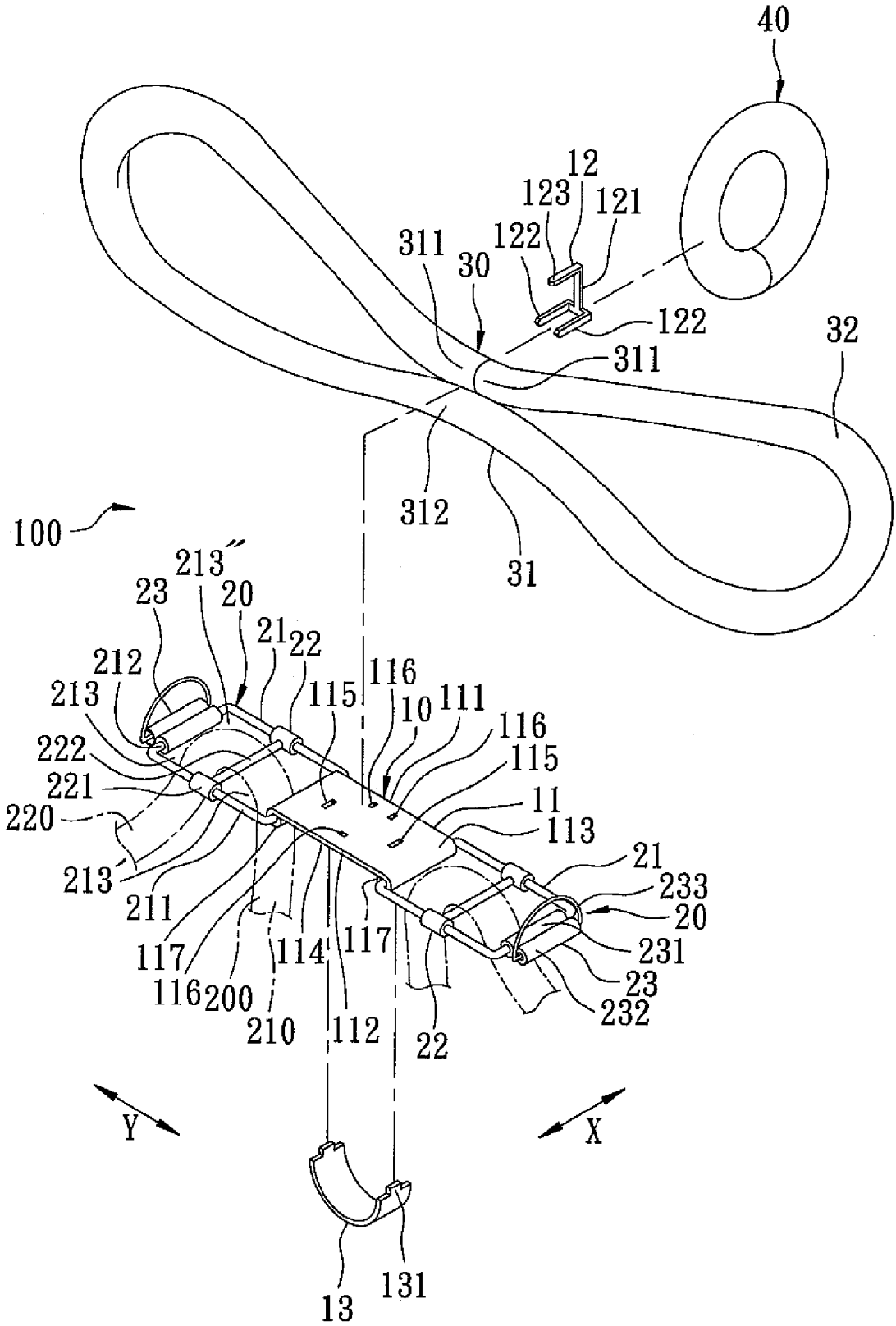
FIG. 2 is an exploded perspective view of a preferred embodiment of a fastener for a lace according to this invention.
Figure 3:
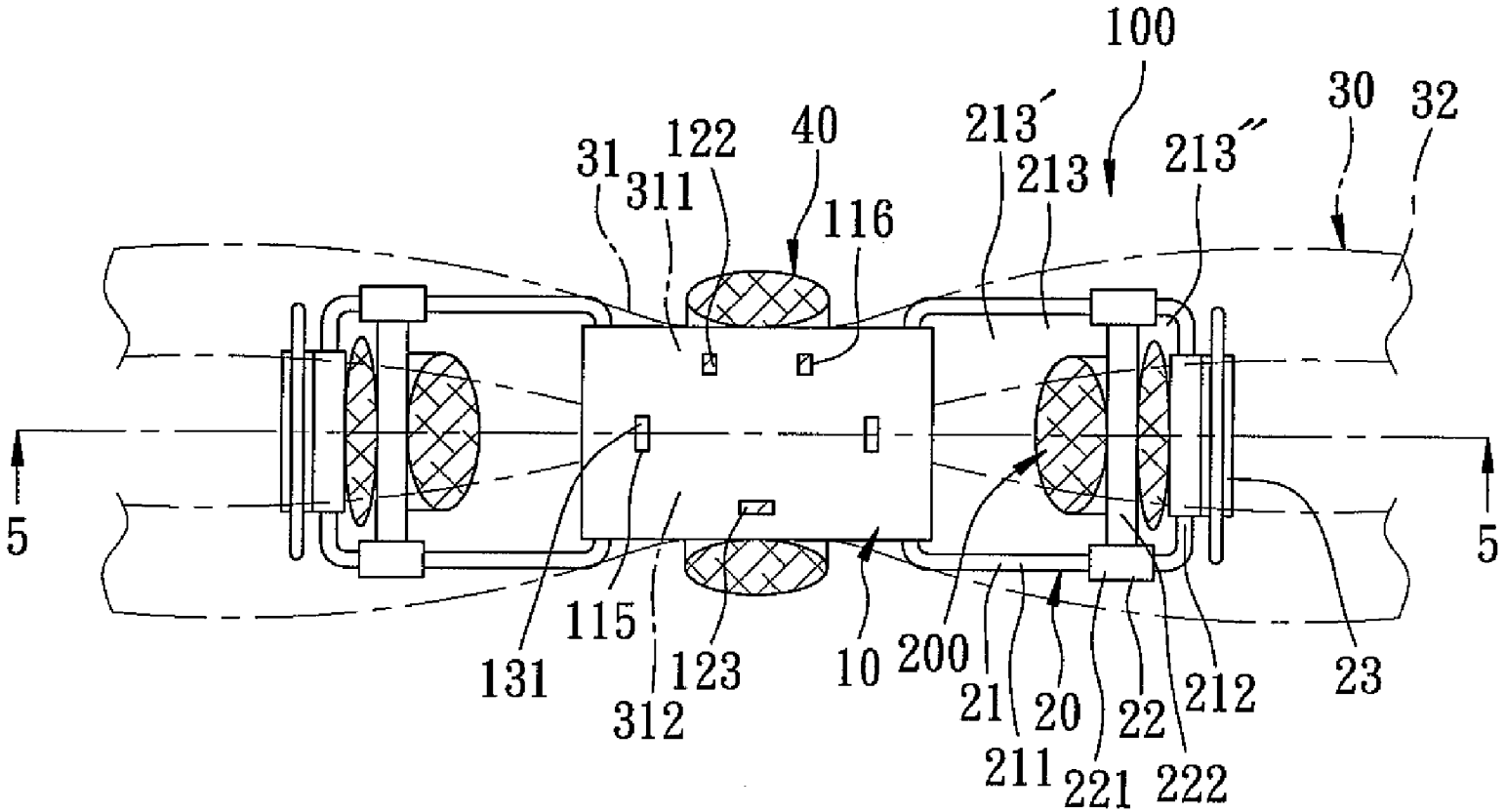
FIG. 3 is a sectional view of the preferred embodiment.
Figure 4:
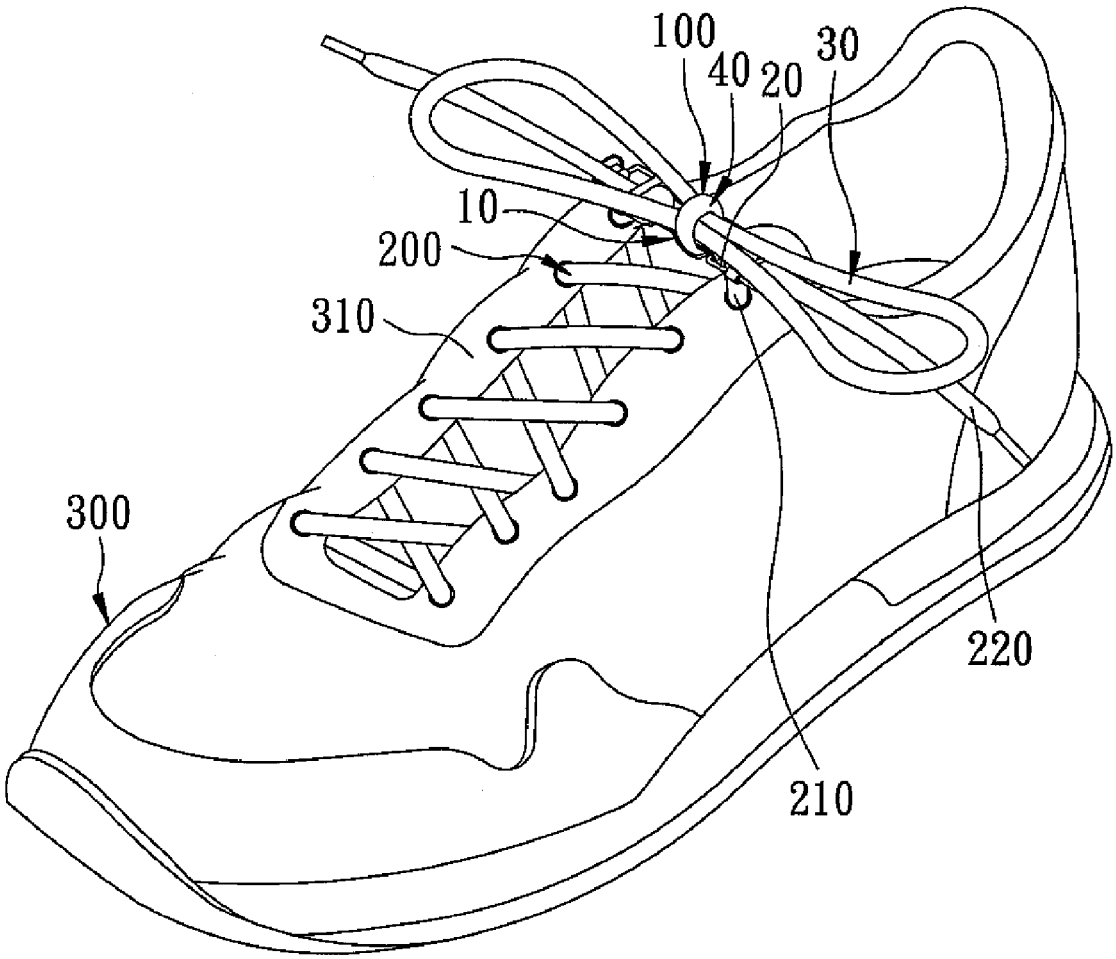
FIG. 4 is a perspective view showing a shoe that incorporates the preferred embodiment of this invention.

Referring to FIGS. 2, 3 and 4, the preferred embodiment of a fastener 100 according to this invention is shown to be adapted for use with a shoe 300 which includes a pair of eyelet tabs 310 and a shoelace 200 having an anchoring segment 210 strung on the eyelet tabs 310, and a pair of distal lace segments 220, each of which is connected to the anchoring segment 210 at one end. The fastener 100 includes a metal base 10, two clamp assemblies 20, a pull unit 30, an anchoring member 12, a ring 40, and a curved retaining member 13. It should be noted herein that, except for FIG. 4, the fastener 100 is not drawn to scale in the accompanying drawings and is actually illustrated in a magnified form for the sake of clarity. Although the fastener 100 of this invention as exemplified in the preferred embodiment is used together with a shoe, it can also be used in other applications, such as clothes, backpacks, hats, and the like.

The metal base 10 is formed as a plate, and includes a plate body 11 and two opposite edge portions 117 integral with the plate body 11. Each of the edge portions 117 is rolled to form a sleeve defining a pivot hole that extends in a first direction (X). The plate body 11 includes a first side face 111, a second side face 112 opposite to the first side face 111 in the first direction (X), a top face 113 extending between the first and second side faces 111,112, a bottom face 114 opposite to the top face 113, two connecting holes 115 each extending through the top and bottom faces 113,114, and a plurality of anchoring holes 116 extending through the top and bottom faces 113,114.

Each of the clamp assemblies 20 includes a substantially U-shaped member 21 and a joining member 23.

The substantially U-shaped member 21 has two opposite arms 211 extending in a second direction (Y) transverse to the first direction (X) and pivotally connected to a corresponding one of the edge portions 117 of the metal base 10, a U-bend 212 connected to the arms 211 opposite to the metal base 10 so as to define an opening 213 with the metal base 10, and a clamp member 22 connected between and transverse to the arms 211. The clamp member 22 includes two opposite sleeves 221 mounted slidably on the opposite arms 211 respectively, and a clamping rod 222 extending between the sleeves 221 to divide the opening 213 into a first aperture 213' proximate to the metal base 10 and a second aperture 213" distal from the metal base 10.

The joining member 23 has a first tube 231 sleeved onto the U-bend 212 of the U-shaped member 21, a second tube 232 welded and connected to and parallel to the first tube 231, and a joining ring 233 penetrating through the second tube 232.

The pull unit 30 includes a middle portion 31 disposed over the plate body 11 of the metal base 10, and two opposite pull members 32 extending from the middle portion 31 and connected respectively to the U-shaped members 21 by joining the joining ring 233 of the joining member 23 to a corresponding one of the pull members 32. The pull unit 30 is formed from a string having two string end parts 311, and a middle string part 312. The string end parts 311 are end to end facing each other and substantially parallel to the middle string part 312. The middle portion 31 of the pull unit 30 is defined by the string end parts 311 and the middle string part 312.

The anchoring member 12 is made of metal, and has a press part 121 formed as a T-shape and pressing the middle portion 31 of the pull unit 30 against the plate body 11 of the metal base 10, and a plurality of anchoring legs 122,123 extending from the press part 121 and penetrating the middle portion 31 of the pull unit 30. One of the anchoring legs 123 penetrates through the middle string part 312, and the other two of the anchoring legs 122 penetrate the string end parts 311 respectively. The anchoring legs 122,123 are inserted respectively into the anchoring holes 116, and are welded to the plate body 11 of the metal base 10 in the anchoring holes 116.

The ring 40 surrounds the plate body 11 of the metal base 10 and the middle portion 31 of the pull unit 30.

The curved retaining member 13 is fixed to the plate body 11 of the metal base 10 opposite to the anchoring member 12 so as to embrace a portion-of the ring 40. The curved retaining member 13 includes two opposite end portions 131 received in the connecting holes 115 of the metal base 10 and welded to the plate body 11 of the metal base 10.

Figure 5:
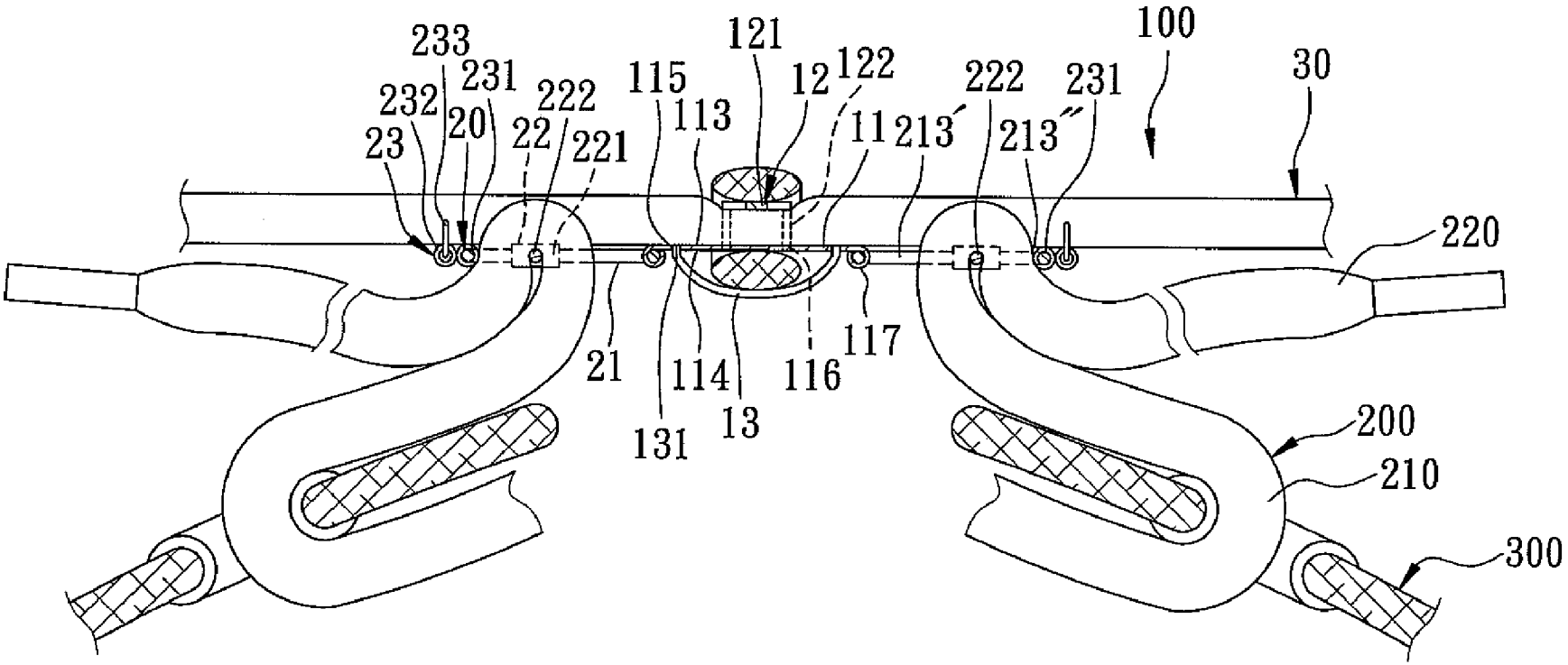
FIG. 5 is a fragmentary sectional view taken along line 5-5 in FIG. 3 to illustrate a tightening operation of the preferred embodiment.

Referring again to FIGS. 3, 4 and 5, in use, each of the distal lace segments 220 is extended through the first aperture 213' of the opening 213, over the clamp member 22 of a corresponding one of the clamp assemblies 20, into the second aperture 213" of the opening 213, and out of the U-bend 212 of the U-shaped member 21 of the corresponding one of the clamp assemblies 20. At the same time, the pull unit 30, the ring 40, and the distal lace segments 220 cooperate to form a double-bow configuration. After a foot (not shown) is slipped into the shoe 300, the distal lace segments 220 can be pulled apart from each other to tighten the shoe 300. When the shoe 300 is tightened, the eyelet tabs 310 are forced apart by the foot in the shoe 300, thereby applying tension on the shoelace 200. At the same time, the clamp member 22 of each of the clamp assemblies 20 is forced by a corresponding one of the distal lace segments 220 to move toward the U-bend 212 of the U-shaped member 21 of the corresponding one of the clamp assemblies 20 such that each of the distal lace segments 220 is clamped in a clamping position between the clamp member 22 and the U-bend 212 of the corresponding one of the clamp assemblies 20 for maintaining a tightened state of the shoe 300 (best shown in FIGS. 4 and 5).

Figure 6:
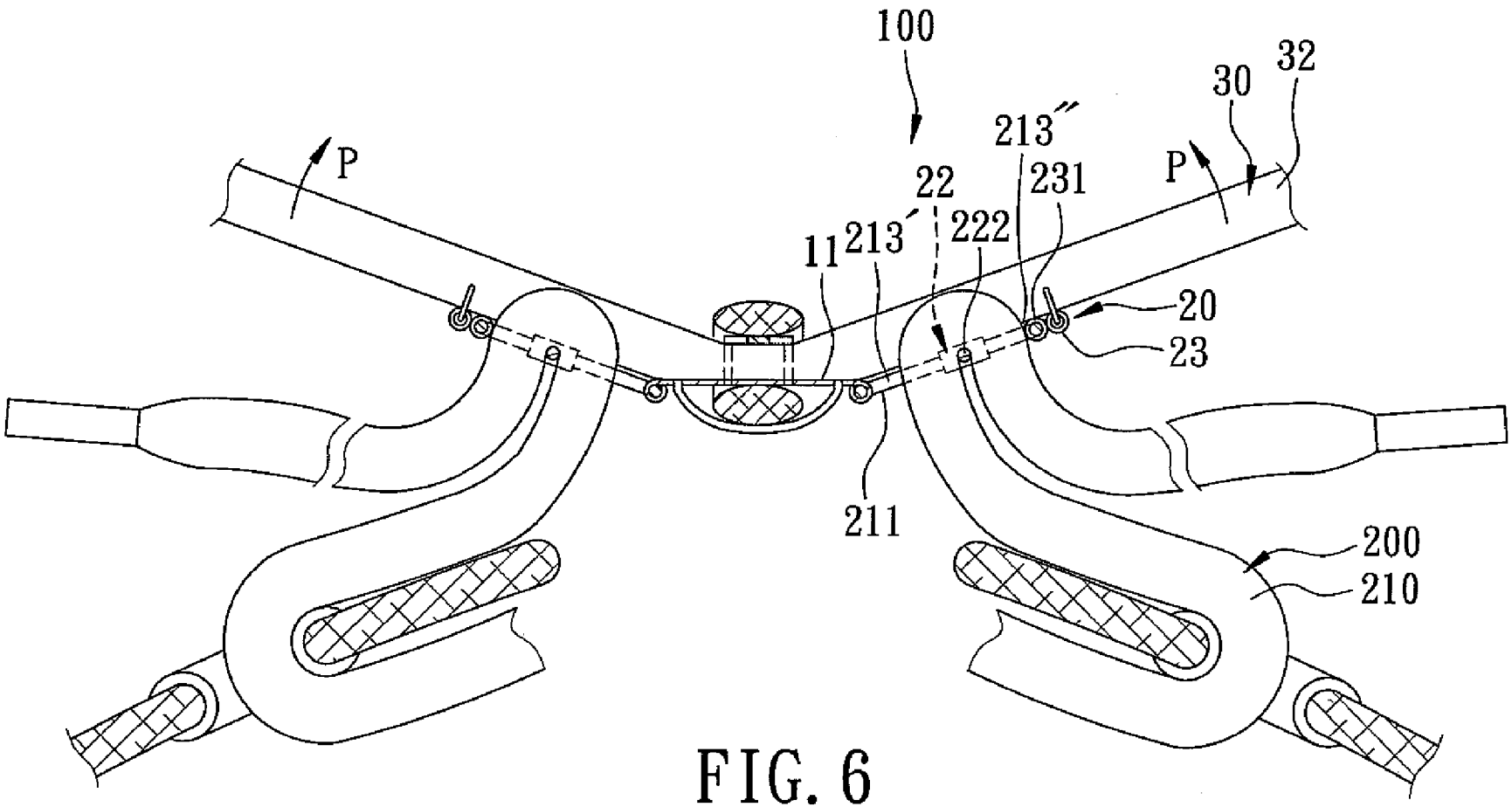
FIG. 6 is a fragmentary sectional view illustrating a loosening operation of the preferred embodiment.

Referring to FIG. 6, to loosen the shoe 300, a manual pulling force is applied on the pull members 32, as indicated by arrows (P). This results in pivoting movement of the clamp assemblies 20 relative to the metal base 10 toward each other and in movement of the clamp member 22 away from the U-bend 212 of the U-shaped member 21 of the corresponding one of the clamp assemblies 20, thereby releasing the distal lace segments 220 from being clamped by the clamp members 22 against the U-bends 212 so as to permit sliding movement of the distal lace segments 220 for loosening the shoe 300 accordingly.

In view of the aforesaid, the fastener 100 of this invention has the following advantages:

1. The anchoring legs 122,123 of the anchoring member 12 penetrate the middle portion 31 of the pull unit 30 and are welded to the plate body 11 of the metal base 10 in the anchoring holes 116. Therefore, the pull unit 30 can be held simply and securely on the plate body 11 of the metal base 10, and the binding strength between the anchoring member 12 and the metal base 10 is improved as compared to the prior art.

2. The ring 40 surrounds the plate body 11 of the metal base 10 and the middle portion 31 of the pull unit 30, and the curved retaining member 13 is welded to the plate body 11 of the metal base 10 to embrace a portion of the ring 40. Therefore, in addition to a decorative effect, the ring 40 can be used to further fasten the middle portion 31 of the pull unit 30 on the plate body 11 of the metal base 10.

3. The size of the metal body 10 can be designed to be smaller as compared to the prior art, and the U-shaped member 21 is formed as a rectangular ring so as not to result in an adverse affect on the appearance of the shoe.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A fastener for a lace, comprising:

a metal base;

two clamp assemblies each including a substantially U-shaped member which has two opposite arms pivotally connected to said metal base, a U-bend connected to said arms opposite to said metal base, and a clamp member connected between and transverse to said arms;

a pull unit including a middle portion disposed over said metal base, and two opposite pull members extending from said middle portion and connected respectively to said U-shaped members; and an anchoring member made of metal, and having a press part pressing said middle portion of said pull unit against said metal base, and a plurality of anchoring legs extending from said press part, penetrating said middle portion of said pull unit, and welded to said metal base.

2. The fastener as claimed in claim 1, wherein said metal base is formed as a plate, said clamp member including two opposite sleeves mounted slidably on said opposite arms respectively, and a clamping rod extending between said sleeves.

3. The fastener as claimed in claim 1, wherein said metal base includes a plurality of anchoring holes, said anchoring legs of said anchoring member being inserted respectively into said anchoring holes and welded to said metal base in said anchoring holes.

4. The fastener as claimed in claim 1, wherein said pull unit is formed from a string having two string end parts, and a middle string part, said two string end parts being end to end facing each other and substantially parallel to said middle string part, said middle portion of said pull unit being defined by said two string end parts and said middle string part, one of said anchoring legs penetrating through said middle string part and the other two of said anchoring legs penetrating said string end parts, respectively.

5. The fastener as claimed in claim 1, further comprising a ring surrounding said metal base and said middle portion of said pull unit.

6. The fastener as claimed in claim 5, further comprising a curved retaining member fixed to said metal base opposite to said anchoring member so as to embrace a portion of said ring, said curved retaining member including two opposite end portions welded to said metal base.

7. The fastener as claimed in claim 6, wherein said metal base further has two connecting holes receiving said end portions of said curved retaining member, respectively.

8. The fastener as claimed in claim 1, wherein each of said clamp assemblies further includes a joining member having a first tube sleeved onto said U-bend of said U-shaped member, a second tube connected to and parallel to said first tube, and a joining ring penetrating through said second tube and joined to a corresponding one of said pull members of said pull unit.

* * * * *